US007748525B2

(12) United States Patent
Boyd

(10) Patent No.: US 7,748,525 B2
(45) Date of Patent: Jul. 6, 2010

(54) CLOSURE AND CONTAINER COMBINATION FOR REDUCING HEADSPACE GAS

(75) Inventor: Timothy J Boyd, Ypsilanti, MI (US)

(73) Assignee: Amcor Limited, Hawthorn, Victoria (AU)

( * ) Notice: Subject to any disclaimer, the term of this patent is extended or adjusted under 35 U.S.C. 154(b) by 1502 days.

(21) Appl. No.: 10/601,998

(22) Filed: Jun. 23, 2003

(65) Prior Publication Data

US 2004/0084333 A1 May 6, 2004

Related U.S. Application Data

(62) Division of application No. 10/023,303, filed on Dec. 18, 2001, now Pat. No. 6,688,081.

(51) Int. Cl.
*B65D 51/16* (2006.01)

(52) U.S. Cl. ..... 206/213.1; 220/368; 206/814

(58) Field of Classification Search ..... 220/227, 220/366.1, 368, 203.13; 206/524.8, 525, 206/814, 0.6, 213.1

See application file for complete search history.

(56) References Cited

U.S. PATENT DOCUMENTS 3,578,467 A * 5/1971 Huber ..... 426/112
4,188,457 A * 2/1980 Throp ..... 215/261
4,347,695 A 9/1982 Zobel et al.
4,424,659 A 1/1984 Perigo et al.
4,892,227 A * 1/1990 MacLaughlin ..... 220/270
5,103,990 A 4/1992 Irwin
5,147,057 A * 9/1992 Marshall et al. ..... 220/268
5,305,583 A 4/1994 Linner
5,323,589 A 6/1994 Linner
5,443,853 A 8/1995 Hayes
5,452,563 A 9/1995 Marano et al.
5,473,860 A 12/1995 Linner
5,519,984 A 5/1996 Beussink et al.
5,692,638 A * 12/1997 Perry ..... 220/624
5,715,874 A 2/1998 Reynolds et al.
5,833,088 A * 11/1998 Kladders et al. ..... 215/248
5,857,312 A 1/1999 Walden
5,947,274 A 9/1999 Taskis et al.
6,145,688 A 11/2000 Smith
6,294,115 B1 9/2001 Blizard et al.
6,398,051 B1 * 6/2002 Brozell et al. ..... 215/231

OTHER PUBLICATIONS

The Wiley Encyclopedia of Packaging Technology, Second Edition, John Wiley & Sons, Inc., 1997, pp. 687-692.

* cited by examiner

*Primary Examiner*—Jacob K Ackun, Jr.
(74) *Attorney, Agent, or Firm*—Harness, Dickey & Pierce, P.L.C.

(57) ABSTRACT

A closure and container combination for packaging and sealing a commodity in a container that reduces headspace gases, in particular oxygen, allowing the packaged commodity to have a longer shelf life.

22 Claims, 2 Drawing Sheets

CLOSURE AND CONTAINER COMBINATION FOR REDUCING HEADSPACE GAS

This application is a divisional application of U.S. Ser. No. 10/023,303, filed on Dec. 18, 2001, pending.

TECHNICAL FIELD OF THE INVENTION

This invention generally relates to a method for packaging foods and beverages in a container made of polymer materials. More specifically, this invention generally relates to a method of using a closure that mechanically displaces container gases and is particularly useful for hot-filled and pasteurized products packaged in a heat-set polyester container with a wide-mouth opening. Furthermore, this invention is particularly useful for packaging oxygen sensitive foods and beverages where a longer shelf life is desirable.

BACKGROUND

In most product filling operations, packagers generally fill the product to a level somewhat below the container's highest level. In other words, product volume is generally less than total available container volume. Packagers often refer to differences between product volume and container volume as headspace.

Maintaining container headspace is often desirable for two basic reasons. First, packagers prefer to fill the container based on a pre-measurement of product weight or product volume, for example, a product weight of 500 grams or a product volume of 750 milliliters. Headspace provides a tolerance for subtle differences in product density or container capacity. Second, and perhaps more important, container headspace enables the packager to minimize waste and mess from spillage and overflow of liquids on a high-speed package filling line. High-speed filling lines will generally shake and jostle the filled container risking spillage before the container is sealed. Spillage is a particular concern for wide-mouth containers. Furthermore, spillage can undermine a packager's need to assure consumers that the package contains a full measure of product.

The industry generally considers as wide-mouth any bottle or jar having an opening approximately 50, percent or more in size relative to the container's width or major diameter. In contrast, bottles having an opening substantially less than 50 percent are narrow-neck. As a percentage of overall bottle capacity, wide-mouth bottles tend to have and require more headspace than a narrow-neck version of otherwise similar proportions. Narrow-neck bottle geometry naturally reduces headspace. Moreover, less risk of spillage from the narrow-neck bottle allows packagers to position the fill-level nearer the top further reducing headspace.

Headspace contains gases that in time can damage some products or place extra demands on container structural integrity. Examples include products sensitive to oxygen and products filled and sealed at elevated temperatures.

Filling and sealing a rigid container at elevated temperatures can create significant vacuum forces when excessive headspace gas is also present. Accordingly, less headspace gas is desirable with containers filled at elevated temperatures, sometimes known as "hot-fill," to reduce vacuum forces acting on the container that could compromise structural integrity, induce container stresses, or significantly distort container shape.

On the other hand, rigid containers experience less internal pressure during pasteurization and retort processes with excessive headspace gas. In-container pasteurization and retort processes involve filling the container first, sealing, and then subjecting the package to elevated temperatures for a sustained period. Metal cans are an example of a package often with excessive headspace.

Interestingly, more flexible polymer containers with minimum headspace gas do not experience significant pressure increases during the pasteurization and retort processes, as is the case with rigid containers. This result is from a greater thermo-expansion of the polymer or plastic relative to rigid glass and metal. This expansion changes the internal volume of the container enough to minimize internal gas pressure increases. Consequently, extra headspace desirable in rigid containers is undesirable in flexible, less rigid containers subjected to pasteurization or retort process.

Traditionally, packagers considered only glass and metal materials for packaging oxygen sensitive products and/or products filled and sealed at elevated temperatures. Both glass and metal materials are relatively low cost, provide an excellent gas barrier, are stiff and generally maintain size and shape, and adequately resist the elevated temperatures found in hot-fill, pasteurization, and retort processes.

On the other hand, metal containers are not transparent and have limited size configuration. Glass containers are heavy often weighing nearly as much as the product. Nonetheless, near perfect gas barrier performance of glass and metal materials minimizes concern for oxygen trapped in the headspace and for some applications minimizes concern from excessive headspace volume.

Until recently, packagers have not seriously considered versatile and ultra lightweight polymer or plastic materials for demanding oxygen sensitive and hot-fill product applications, particularly wide-mouth bottle and jar applications. This is because polymers are generally imperfect barriers to oxygen. Nonetheless, the industry now has a variety of polymers that are well equipped to deal with the practical demands made by oxygen sensitive foods and the marketplace. Those skilled in the art of plastics packaging readily recognize acrylonitrile, nylon or polyamide, ethylene vinyl alcohol, and polyesters, such as, polyethylene naphthalate, modified polyethylene terephthalate, and polyethylene terephthalate copolymers, and many other polymers and polyesters as examples having excellent passive gas barrier performance either individually or as part of a multilayer structure. Some polymers and materials added to polymers create an active gas barrier. Active gas barriers seek out and absorb free oxygen before oxidation of the packaged product occurs.

Manufacturing methods to create multilayer structures of two or more polymers and heat-set techniques to thermally stabilize the container and improve crystalline structure of certain polymers are well known. These techniques play a role enhancing package performance.

Those skilled in the art are aware of several container manufacturing heat-set processes for improving package heat-resistant performance. In the case of the polyester, polyethylene terephthalate, for example, the heat-setting process generally involves relieving stresses created in the container during its manufacture and to improve crystalline structure. Typically, a polyethylene terephthalate container intended for a cold-fill carbonated beverage has higher internal stresses and less crystalline molecular structure than a container intended for a hot-fill, pasteurized, or retort product application. Advanced heat-set approaches include processes disclosed in U.S. Pat. Nos. 6,485,669 and 6,514,451, and U.S. patent application Ser. No. 09/607,817, which are incorporated herein by reference.

Moreover, packagers are more sophisticated and better able to manage product distribution channels. In turn, packagers are now able to define package performance requirements and focus needs case-by-case that enable polymer or plastic based solutions not previously considered practical.

While providing excellent performance, polymers still do not provide a perfect solution. For many product applications, removal of headspace oxygen will often make a difference between package failure and success. The following realistic but hypothetical example illustrates this point.

The amount of oxygen a packaged product can tolerate governs its acceptable shelf life. Air is the headspace gas found most often in sealed containers and contains approximately 21 percent free oxygen. A bottle containing 48 ounces (1362 grams) of product and approximately 30 milliliters of headspace has an oxygen-to-product ratio of about 6.6 parts per million (PPM), assuming no other oxygen sources. Assume the 30 milliliters of headspace is the minimum volume that reasonably minimizes spillage during filling-line handling. The product of this example has an acceptable quality limit of 30 PPM oxygen or less. Higher levels of product oxidation will generally cause noticeable changes in color and/or changes in taste. Assume further that the rate of oxygen ingress into the bottle is about 35 PPM per year. Consequently, the headspace oxygen coupled with oxygen ingress, will grant a product shelf life of about 263 days. However, remove headspace oxygen, and acceptable product shelf life will increase 19 percent to about 313 days.

One solution for modifying headspace atmosphere or removing headspace oxygen is a nitrogen flush. This approach usually involves the addition of one or more drops of liquid nitrogen onto the just filled product immediately before applying the closure and seal. The liquid nitrogen vaporizes expelling the air with its oxygen. While effective, the timing and quantity of liquid nitrogen added is very critical when applied to a lightweight plastic container. Consistency is often difficult to achieve. Too much nitrogen creates internal pressure often giving the plastic container a somewhat bloated appearance. Too little nitrogen is ineffective at expelling the air thus allowing oxygen to remain that shortens product shelf life. Furthermore, the nitrogen flush approach requires additional equipment that many packagers are reluctant to acquire.

Packagers using a polymer container, particularly a wide-mouth container, to hold oxygen sensitive products, need a simple method for allowing the benefit of headspace during product fill, minimizing spillage and displacing headspace, minimizing distortions from vacuum forces and/or product deterioration from oxygen.

SUMMARY OF INVENTION

In one form, the present invention provides a method of filling a container so as to provide a longer shelf life for a commodity packaged in the container. The method of the present invention includes the general steps of preparing the container for filling, filling the container with the commodity to a surface level, and allowing a headspace above the surface level sufficient to generally minimize spillage of the commodity. A closure is then attached to the container displacing a portion of the gases in the headspace and sealing the container. Finally, the filled and sealed container is stored.

In another form, the present invention provides a closure and container combination for reducing headspace gas. The closure and container combination includes an engaging means for engaging the closure to a container finish, a headspace displacing member, a clearance between the container finish and the headspace displacing member and a sealing means. In the closure and container combination of the present invention, the container contains a commodity and a headspace gas, and the closure displaces a portion of the headspace gas.

From the following description of the preferred embodiment, the appended claims, and the accompanying drawings, additional benefits and advantages of the present invention will become apparent to those skilled in the art to which this invention relates.

DETAILED DESCRIPTION

The preferred method for reducing headspace gases uses a closure that mechanically displaces headspace gases when applying the closure to a filled container as part of the overall product or commodity filling process.

Figure 1:
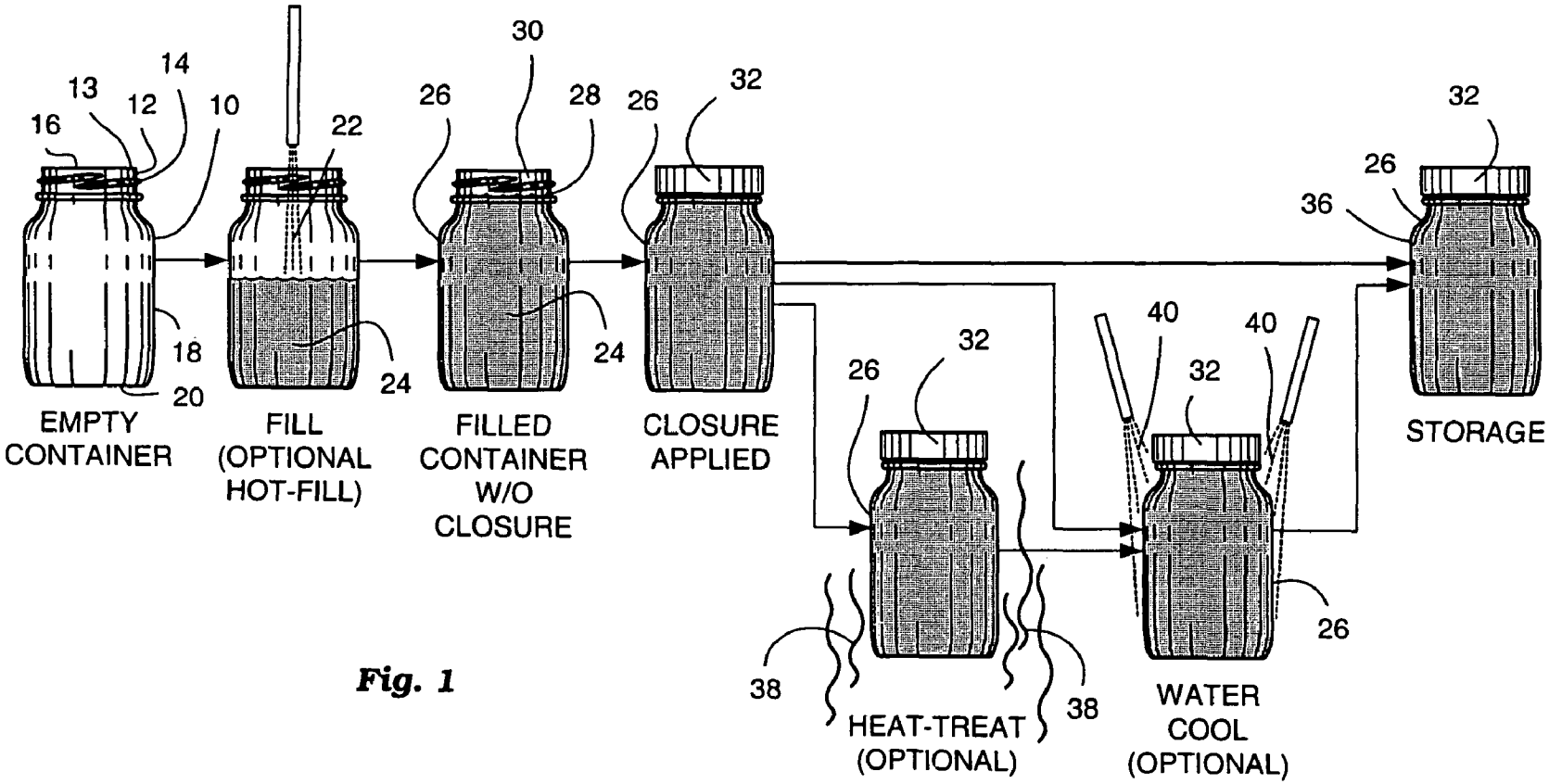
FIG. 1 is a pictorial schematic of the method disclosed by the present invention.

FIG. 1 is a pictorial schematic view of the method of the present invention including optional features. The method in essence begins by preparing an empty container 10 for filling. This preparation generally involves bringing, by some means, the empty container 10, in an upright manner (typically a series of empty containers) to a filling machine (not illustrated). The preparation step can also involve sterilizing (in the case of aseptic fill processes) or washing the empty container 10 by some means.

The empty container 10 has a finish 12 featuring a sealing surface 13 (shown in FIG. 2), an external thread 14, an opening 16, a generally tubular body 18, and a base 20 that closes-off the tubular body 18 at an end opposite the finish 12. While FIG. 1 illustrates an external treaded approach for attaching a closure 32 with a corresponding thread to the finish 12, the invention disclosed herein is not limited to the external treaded approach. Other alternatives for attaching the closure 32 to the container include using an internal threaded finish approach or a groove and ridge "snap-over" approach. Attachment features of the closure cooperate with corresponding features of the finish.

While finish 12 and closure 32 are typically circular in nature, it is not always necessary for the finish 12 and the closure 32 to be circular if using the groove and ridge "snap-over" attachment approach.

Furthermore, while the body 18 of the container is generally tubular, the body 18 is not necessarily a cylinder or circular in cross-section. At minimum, the body 18 will generally feature a shoulder region 17 and a chime region 19 (shown in FIG. 2) that will have a different cross-sectional shape from other body regions. Those skilled in the art will realize that the container body 18 can be any of a number of configurations different from that illustrated.

After the preparation step, the next basic step shown in FIG. 1 is container filling 22. At this step, empty container 10 fills in the filling machine (not illustrated) with a product or commodity 24. Filled container 26 has a filled level 28 leaving a headspace 30, the space between the filled level 28 and the sealing surface 13. The headspace 30 has a volume that varies depending on the commodity or product application and overall container size; however, typically, the volume of the headspace 30 is between 30 and 100 ml for most consumer packaging applications.

A container designer must position the filled level 28 to satisfy two goals. First, the filled level 28 establishes the volume of the headspace 30 that minimizes the risk of spillage of the packaged commodity while handling the container before the closure 32 is applied or attached. Second, the filled level 28 corresponds to a full measure of packaged product. Consumer perceptions also play a role in that a consumer will often view a container with a disproportionately large volume of the headspace 30 as under filled. Thus, container designer must strike a proper balance between consumer perception and handling ease.

The filling of the commodity 24 can be at approximately room temperature or at some elevated temperature. For example, a packager typically hot-fills isotonic beverages at about 82° to 85° C. Other products, such as applesauce or spaghetti sauce are typically hot-filled at about 88° to 96° C. Filling the container with a commodity 24 at an elevated temperature provides packagers additional motivation to reduce the headspace 30 volume. Significant vacuum forces generate as the hot commodity cools and contracts in the sealed container. These vacuum forces can easily distort a more flexible container made of polymers. Unfortunately, the volume of the headspace 30, needed to avoid spillage, particularly in a wide-mouth polymer container, may be too great to avoid container distortions from vacuum forces or avoid triggering under fill concerns by the consumer.

Figure 4:
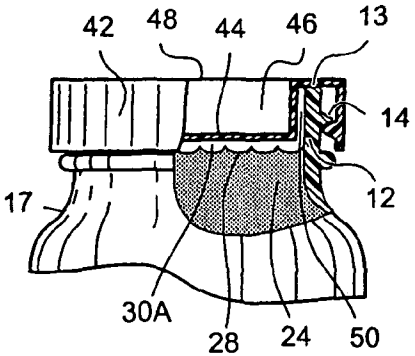
FIG. 4 is a partial view of the container shown in FIG. 2 with a partial breakout cross-sectional view of an attached closure for use with the disclosed method.
Figure 5:
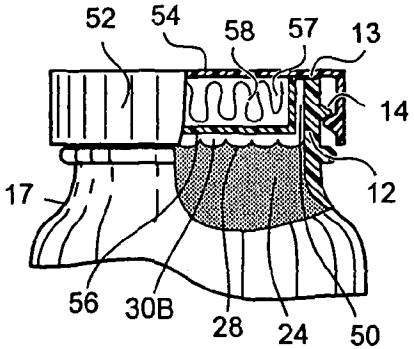
FIG. 5 is a partial view similar to FIG. 4 showing another closure embodiment with an active agent.
Figure 6:
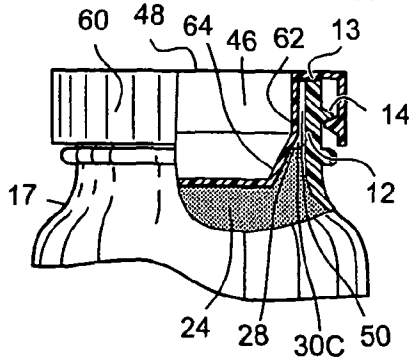
FIG. 6 is a partial view similar to FIG. 4 showing another closure embodiment that shifts a portion of the commodity.
Figure 2:
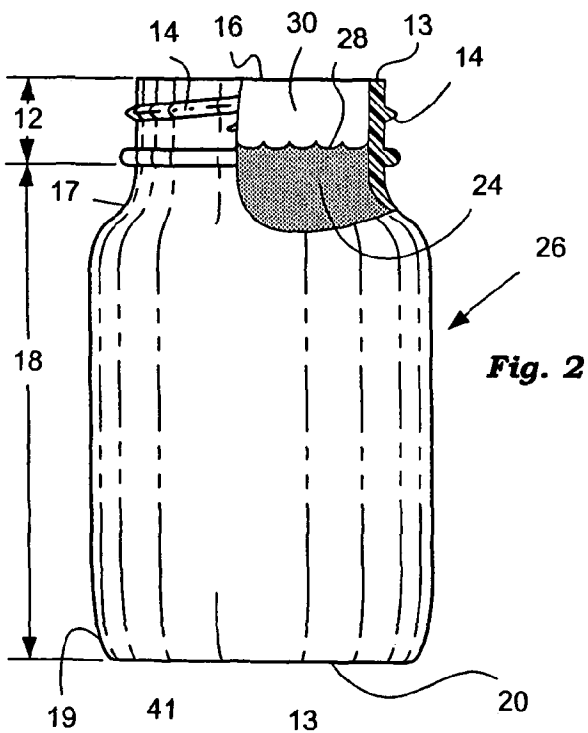
FIG. 2 is a side view of a typical wide-mouth container with a partial breakout cross-sectional view showing a typical commodity level after filing.

The next step shown in FIG. 1 is applying or attaching the closure 32 to the container creating a closure and container combination. There is a variety of closure configurations that function in a similar manner, that is, to mechanically displace headspace gas with, in general terms, a closure headspace-displacing member. The closure 32 is a general reference and represents all possible closure varieties suitable for this method. The preferred embodiment of the method allows the gases in the headspace 30 to readily vent through a clearance 50 (as shown in FIGS. 4, 5, and 6) as the closure 32 attaches to the filled container 26. Container seal occurs as the closure 32 contacts the sealing surface 13 (FIG. 2). This contact with the sealing surface 13 is clearly seen in specific closure varieties illustrated in FIGS. 4, 5, and 6 respectively with a hollow closure 42 (FIG. 4), a scavenger closure 52 (FIG. 5), and a hollow headspace-commodity-shift closure 60 (FIG. 6). The clearance 50 assures the packager that gases displaced from the headspace 30 properly escape before the container seal is complete against the sealing surface 13.

Fundamentally, the last step shown in FIG. 1 is container storage 36. Container storage 36 begins when sealing the filled container 26 with the closure 32 is complete and ends when a consumer removes the closure 32 from the filled container 26. The storage period may last from a few minutes to as long as a year or two and involves elements of a distribution channel, including filling site warehousing, distributorship warehousing, grocer shelf display, and consumer delay of use. The method of this invention for a given commodity or product, a given container 10, and a given filled level 28, helps lengthen available product shelf life.

Depending on the commodity or product application and other product specific details, the method shown in FIG. 1 may include one or two additional steps. The method may include the step of cooling the filled container 26 with the closure 32, particularly if hot-filled, with a water spray 40 to reduce overall package temperature to about room temperature before storage 36 begins. In another alternative, the method may further include treating the filled container 26 with the closure 32 with a heat-treatment 38 to effectively cook the commodity in the container. The heat-treatment 38 may include in-container pasteurization and retort approaches that heat the container and commodity to a temperature as high as 120° C. for as long as 30 minutes.

Figure 3:
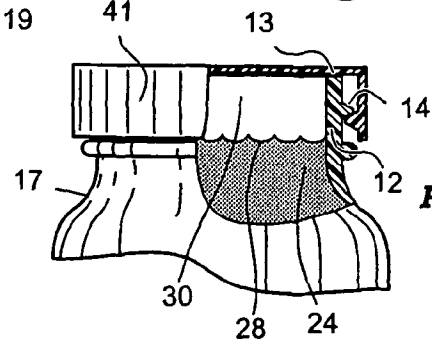
Fig. 3 Prior Art
FIG. 3 is a partial view of the container shown in FIG. 2 with a partial breakout cross-sectional view of an attached prior art closure.

FIG. 3 is a partial view of the filled container 26 shown in FIG. 2 with a partial breakout cross-sectional view of an attached prior art closure 41. While the prior art closure 41 is adequate for sealing the filled container 26 against the sealing surface 13, the prior art closure 41 does not reduce the headspace 30 size or volume.

FIG. 4 is a partial view of the filled container 26 shown in FIG. 2 with a partial breakout cross-sectional view of a hollow closure 42 alternative: for practicing the disclosed method shown in FIG. 1.

The hollow closure 42 features a hollow headspace-displacing member 44 that reduces headspace gases. A twisting action of the hollow closure 42 along the thread 14 of the finish 12 advances the hollow headspace-displacing member 44 into the filled container 26 to cause gases in the headspace 30 (FIG. 2) to vent through the clearance 50 and escape over the thread 14 before the hollow closure 42 completely seals against the sealing surface 13, thus creating a significantly reduced headspace 30A. Hollow closure 42 is effective if it displaces as little as 25% or less of headspace 30; however, it is more effective if it displaces more than 50%, 75%, 90%, or 95% of headspace 30. In other words, reduced headspace 30A is as little as 5% or less of headspace 30 or as much as about 75% of headspace 30. Those skilled in the art will understand that the hollow closure 42 will likely use a compliant gasket material (not illustrated) to seal against the sealing surface 13. Those skilled in the art will also realize that a snap-on style closure attachment means in place of a more traditional threaded closure attachment means as shown in FIGS. 4, 5, and 6 is feasible. Any suitable material is appropriate for manufacturing the hollow closure 42; however, metal or polymer materials that provide adequate gas barrier are most effective.

If necessary, the hollow closure 42 can have a hollow space cover sheet 48 to conceal the hollow space 46. The hollow space cover sheet 48 is of any number of materials including paper, foil, polymer film, and so forth. Any form of attachment of the hollow space cover sheet 48 to the hollow closure 42 is feasible; however, those skilled in the art will likely choose an adhesive.

FIG. 5 is a partial view of the filled container 26 shown in FIG. 2 with a partial breakout cross-sectional view of a scavenger closure 52 alternative for practicing the disclosed method shown in FIG. 1.

The scavenger closure 52 features three main components; a scavenger closure body 54, a scavenger closure headspace-displacing member 56, and an agent 58. Although not necessarily identical, the scavenger closure body 54 is similar in configuration to the prior art closure 41 (FIG. 3). Any suitable material is appropriate for manufacturing the scavenger closure body 54; however, metal or polymer materials that provide adequate gas barrier are most effective.

The scavenger closure headspace-displacing member 56 is similar in shape to the hollow headspace-displacing member 44 and attaches permanently to the scavenger closure body 54 to create a scavenger closure hollow space 57 for housing the agent 58. The scavenger closure headspace-displacing member 56 creates a physical barrier that prevents direct contact of the agent 58 with the commodity 24, but establishes a relatively thin membrane that allows gases, in particular oxygen, water vapor, and other volatile gases, to permeate through and react with the agent 58.

Many materials are suitable for manufacturing the scavenger closure headspace-displacing member 56, including common package materials polystyrene, polyethylene, polypropylene, and others. Furthermore, a closed-cell micro-cellular foam of any of the above polymer materials, either injection molded or thermoformed from an extruded sheet, is a viable approach for manufacturing the scavenger closure headspace-displacing member 56. U.S. Pat. No. 6,294,115 assigned to Trexel, Inc., Woburn, Mass. discloses examples of micro-cellular manufacturing techniques. The micro-cellular foam creates a relatively stiff but effectively thin gas permeable membrane for the scavenger closure headspace-displacing member 56.

The scavenger closure headspace-displacing member 56 attaches to the scavenger closure body 54 by any one of a number of conventional means, including, spin welding, adhesives, friction, or snap or threaded attachment means with or without a gasket.

The agent 58 within the scavenger closure hollow space 57 can be any number or combination of scavengers, desiccants, and other absorbers, including, iron based compounds and salts, ascorbic acid, cobalt, zinc, and manganese based compounds and salts, active-carbon compounds, silica, and zeolite and other similar compounds.

A twisting action of the scavenger closure 52 along the thread 14 of the finish 12 advances the scavenger closure headspace-displacing member 56 into the filled container 26 to cause gases in the headspace 30 (FIG. 2) to vent through the clearance 50 and escape over the thread 14 before the scavenger closure 52 completely seals against the sealing surface 13. The scavenger closure headspace-displacing member 56 and the agent 58 cooperate to establish a reduced and scavenged headspace 30B. Scavenger closure 52 is effective if it displaces as little as 25% or less of headspace 30; however, it is more effective if it displaces more than 50%, 75%, 90%, or 95% of headspace 30. In other words, scavenged headspace 30B is as little as 5% or less of headspace 30 or as much as about 75% of headspace 30. Those skilled in the art will understand that the scavenger closure 52 will likely use a compliant gasket material (not illustrated) to seal against the sealing surface 13.

Additionally, it is contemplated that the scavenger closure headspace-displacing member 56 can incorporate an agent-like compound blended within its structural material that allows the scavenger closure headspace-displacing member 56 itself to also attract and scavenge oxygen and other gases directly.

FIG. 6 is a partial view of the filled container 26 shown in FIG. 2 with a partial breakout cross-sectional view of a hollow headspace-commodity-shift closure 60 alternative for practicing the disclosed method shown in FIG. 1.

The hollow headspace-commodity-shift closure 60 features a hollow headspace-commodity-shift member 62 that shifts a portion of the commodity 24 with a shifting extension 64 that further reduces headspace gases. A twisting action of the hollow headspace-commodity-shift closure 60 along the thread 14 of the finish 12 advances the hollow headspace-commodity-shift member 62 and the shifting extension 64 into the filled container 26 to cause gases in the headspace 30 (FIG. 2) to vent through the clearance 50 and escape over the thread 14. As the hollow headspace-commodity-shift member 62 and the shifting extension 64 continues to advance, it comes in contact with the commodity 24 causing a portion of the commodity 24 to shift further causing additional headspace gases to vent through the clearance 50 and escape over the thread 14 before the hollow headspace-commodity-shift closure 60 completely seals against the sealing surface 13 and thus creating a highly reduced headspace 30C. Hollow headspace-commodity shift closure 60 is effective if it displaces as little as 25% or less of headspace 30; however, it is more effective if it displaces more than 50%, 75%, 90%, or 95% of headspace 30. In other words, highly reduced headspace 30C is as little as 5% or less of headspace 30 or as much as about 75% of headspace 30. Those skilled in the art will understand that the hollow headspace-commodity-shift closure 60 will likely use a compliant gasket material (not illustrated) to seal against the sealing surface 13.

While the hollow headspace-commodity-shift member 62 and the shifting extension 64 can together have any of several shapes, it will likely be generally that of either a cylinder, cone, truncated cone, paraboloid or some combination. Any suitable material is appropriate for manufacturing the hollow headspace-commodity-shift closure 60; however, metal or polymer materials that provide adequate gas barrier are most effective.

If necessary, the hollow headspace-commodity-shift closure 60 can have a hollow space cover sheet 48 to conceal the hollow space 46. The hollow space cover sheet 48 is of any number of materials including paper, foil, polymer film, and so forth. Any form of attachment of the hollow space cover sheet 48 to the hollow headspace-commodity-shift closure 60 is feasible; however, those skilled in the art will likely choose an adhesive.

Additionally, it is contemplated that the closures illustrated in FIGS. 4, 5, and 6 can be made of a barrier polymer (such as, polyethylene terephthalate) blended with an oxygen scavenging compound (such as, m-xylylenediamine and adipic acid, commonly known as MXD6 polyamide, itself blended with a cobalt stearate or similar transition metal salt). Furthermore, a modification of the scavenger closure 52 is possible that incorporates the hollow headspace-commodity-shift member 62 and the shifting extension 64 featured on the hollow headspace-commodity-shift closure 60.

The foregoing discussion discloses and describes certain preferred methods and preferred embodiments of the invention. One skilled in the art will readily recognize from such discussion, and from the accompanying drawings and claims, that changes and modifications can be made to the invention without departing from the true spirit and fair scope of the invention as defined in the following claims.

I claim:

1. A closure and heat set, wide mouth container combination, wherein said heat set, wide mouth container contains a commodity and a headspace gas, and said closure displaces a portion of said headspace gas, comprising:

means for sealing said closure against a finish of said heat set, wide mouth container;

a headspace-displacing member attached to said closure;

a cover that is coupled to the headspace-displacing member to define a hollow cavity between the cover and the headspace-displacing member; and a clearance defined between said headspace-displacing member and said finish.

2. The closure and container combination of claim 1 wherein said headspace-displacing member displaces more than 25% of said headspace gas.

3. The closure and container combination of claim 1 wherein said headspace-displacing member displaces more than 50% of said headspace gas.

4. The closure and container combination of claim 1 wherein said headspace-displacing member displaces more than 75% of said headspace gas.

5. The closure and container combination of claim 1 wherein said headspace-displacing member displaces more than 90% of said headspace gas.

6. The closure and container combination of claim 1 wherein said headspace-displacing member displaces more than 95% of said headspace gas.

7. A closure and heat set, wide mouth container combination, wherein said heat set, wide mouth container contains a commodity and a headspace gas, and said closure displaces a portion of said headspace gas, comprising:

means for sealing said closure against a finish of said heat set, wide mouth container;

a hollow headspace-displacing member attached to said closure, wherein said headspace-displacing member includes a portion for housing an agent that interacts with the headspace gas; and a clearance defined between said headspace-displacing member and said finish.

8. The closure and container combination of claim 7 wherein said agent is at least one of an oxygen-scavenging agent and an active-carbon agent.

9. The closure and container combination of claim 8 wherein said oxygen-scavenging agent is at least one of an iron based compound and an ascorbic acid.

10. The closure and container combination of claim 8 wherein said desiccant drying agent is at least one of silica and zeolite.

11. The closure and container combination of claim 1 wherein said closure is made of a polymer containing an oxygen-scavenging compound.

12. The closure and container combination of claim 1 wherein said container is made of a polymer.

13. The closure and container combination of claim 12 wherein said polymer is polyester.

14. The closure and container combination of claim 13 wherein said polyester is substantially one of a polyethylene terephthalate and a polyethylene terephthalate copolymer.

15. The closure and container combination of claim 1 wherein said means for sealing is one of threaded and snap-on attachment means.

16. A closure and heat set, wide mouth container combination, wherein said heat set, wide mouth container includes a finish, and contains a commodity and a headspace gas, and said closure displaces a portion of said headspace gas, comprising:

a headspace-displacing member attached to said closure;

a cover that is coupled to the headspace-displacing member to define a hollow cavity between the cover and the headspace-displacing member;

a clearance defined between said headspace-displacing member and said finish; and means for sealing said closure against a sealing surface of said finish of said heat set, wide mouth container.

17. The closure and container combination of claim 16 wherein said means for sealing is one of threaded and snap-on attachment means.

18. The closure and container combination of claim 16 wherein said headspace-displacing member includes a headspace-commodity-shift member that shifts a portion of the commodity.

19. The closure and container combination of claim 16 further comprising an agent that is housed within the hollow cavity.

20. The closure and container combination of claim 19 wherein said agent is at least one of an oxygen-scavenging agent and an active-carbon agent.

21. The closure and container combination of claim 20 wherein said oxygen-scavenging agent is at least one of an iron based compound and an ascorbic acid.

22. The closure and container combination of claim 16 wherein said closure is made of a polymer containing an oxygen-scavenging compound.

* * * * *